US008162414B2

(12) United States Patent
Weiss

(10) Patent No.: US 8,162,414 B2
(45) Date of Patent: Apr. 24, 2012

(54) DOOR FOR STRUCTURE FOR PRESENTING AND DISPLAYING GOODS

(76) Inventor: Albert Weiss, Osterburken (DE)

( * ) Notice: Subject to any disclaimer, the term of this patent is extended or adjusted under 35 U.S.C. 154(b) by 795 days.

(21) Appl. No.: 12/170,865

(22) Filed: Jul. 10, 2008

(65) Prior Publication Data

US 2009/0021130 A1 Jan. 22, 2009

(30) Foreign Application Priority Data

Jul. 20, 2007 (DE) ..... 10 2007 034 417
Feb. 22, 2008 (DE) ..... 10 2008 010 586

(51) Int. Cl.
*A47F 3/00* (2006.01)

(52) U.S. Cl. ..... 312/138.1; 312/326; 312/329

(58) Field of Classification Search ..... 312/138.1, 312/296, 116, 139.1, 139.2, 139, 329, 326; 49/397, 398, 399, 492.1, 489.1, 498.1; 16/229–231, 16/252; 277/921, 644, 637, 630; 174/567
See application file for complete search history.

(56) References Cited

U.S. PATENT DOCUMENTS

| | | | | | |
|---|---|---|---|---|---|
| 3,140,517 | A | * | 7/1964 | Richter | 49/489.1 |
| 3,378,881 | A | * | 4/1968 | Hentzi et al. | 16/312 |
| 3,398,487 | A | * | 8/1968 | Matyas | 49/239 |
| 4,001,974 | A | * | 1/1977 | Wright | 49/489.1 |
| 4,042,736 | A | * | 8/1977 | Flint | 428/34 |
| 4,084,347 | A | * | 4/1978 | Brown | 49/397 |
| 4,429,509 | A | * | 2/1984 | Vachet et al. | 52/786.1 |
| 4,940,297 | A | | 7/1990 | Borgen | |
| 5,025,531 | A | * | 6/1991 | McCarty | 16/313 |
| 5,061,531 | A | * | 10/1991 | Catalano | 428/34 |
| 5,191,704 | A | * | 3/1993 | McCarty | 29/897.32 |
| 5,265,311 | A | * | 11/1993 | Gard | 16/312 |
| 5,417,272 | A | * | 5/1995 | Marlowe et al. | 160/202 |
| 5,528,865 | A | * | 6/1996 | Johnson et al. | 49/501 |
| 5,584,143 | A | * | 12/1996 | Kennedy | 49/501 |
| 5,879,070 | A | | 3/1999 | Severloh | |
| 6,125,591 | A | * | 10/2000 | Schmidhuber et al. | 49/477.1 |
| 6,138,434 | A | | 10/2000 | Demars et al. | |
| 6,260,305 | B1 | * | 7/2001 | Joyce | 49/496.1 |
| 6,435,630 | B1 | | 8/2002 | Anin et al. | |
| 6,609,350 | B1 | | 8/2003 | Weber | |
| 2008/0211359 | A1 | | 9/2008 | Borgstrom et al. | |
| 2009/0072679 | A1 | * | 3/2009 | Avila et al. | 312/116 |

FOREIGN PATENT DOCUMENTS

| | | | |
|---|---|---|---|
| DE | 202 02 158 | U1 | 7/2002 |
| EP | 0 657 708 | A1 | 6/1995 |
| WO | WO 2006/101874 | A1 | 9/2006 |
| WO | WO 2006/118567 | A1 | 11/2006 |

OTHER PUBLICATIONS

German Patent Office Search Report, Jan. 21, 2009.
EPO Search Report, Nov. 27, 2008.

* cited by examiner

*Primary Examiner* — Darnell Jayne
*Assistant Examiner* — Andres F Gallego
(74) *Attorney, Agent, or Firm* — Dority & Manning, P.A.

(57) ABSTRACT

A door for merchandise display cabinets that show refrigerated or frozen merchandise, features a vertical opening for accessing the merchandise space, is subdivided into compartments arranged vertically on top of each other, and its front part that is accessible by the customer can be closed with transparent doors and be moved horizontally. These doors have been executed as frameless insulating glass planes on which swivel bolts have been directly arranged on the insulating glass pane.

15 Claims, 4 Drawing Sheets

DOOR FOR STRUCTURE FOR PRESENTING AND DISPLAYING GOODS

FIELD OF THE INVENTION

The invention refers to a door for merchandise display cabinets that show refrigerated or frozen merchandise and feature a vertical opening for accessing the merchandise space, is subdivided into compartments arranged vertically on top of each other, and the front part accessible by the customer can be closed with transparent doors that are moved horizontally.

BACKGROUND

There are merchandise display cabinets known as refrigerator or freezer shelves that can be closed with shades for the night so the cold air cannot escape. It is also known that these refrigeration cabinets are provided with glass doors to prevent the cold from escaping during the day as well. In known merchandise display cabinets, the doors are made of a solid frame that incorporates an insulating glass pane (U.S. Pat. No. 5,879,070; EP 0 657 708 A1; WO 2006/101874 A1). The elements needed for moving the door—through which the door is supported and connected to the merchandise display cabinet—are attached to this frame. The frame is equipped with hinges, which in turn are attached to a solid stand of the merchandise display cabinet. This type of construction is not only very expensive, but also significantly restricts the view into the merchandise display cabinet and its compartments. Such frames are also disadvantageous because they act as cold bridges: condensation forms on the frames and panes and restricts the customer's view even more.

SUMMARY

A task of the invention is to create a door for merchandise display cabinets that eliminates the disadvantages of this latest technological advancement. Additional objects and advantages of the invention will be set forth in part in the following description, or may be obvious from the description, or may be learned through practice of the invention.

In one particular embodiment, the door is made as a frameless, self-supporting insulating glass pane on which the elements needed for moving it are arranged right on the insulating glass pane itself. Since this construction largely avoids external materials, it not only eliminates the cold bridges but also gives the customer the best possible view of the goods. Such a solution is also suitable for retrofitting the already existing refrigeration shelves. Reinforcement pieces in the corner areas allow the mounting of swing bolts for moveable storage right on the door made as an insulating glass pane. To accommodate the sealing and closing elements for protecting the edges of the panes, they protrude over the spacer, thereby creating a recess in which closing or sealing elements can be attached. This recess also allows—especially when using LED luminous elements—the placing of a lighting installation. The upper swing bolt is arranged in floating fashion on a bearing bush, so that even large tolerances at the height of the access that opens towards the merchandise space can be easily compensated. The drawings describe the invention details further and show:

DESCRIPTION OF PARTICULAR EMBODIMENTS

Figure 1:
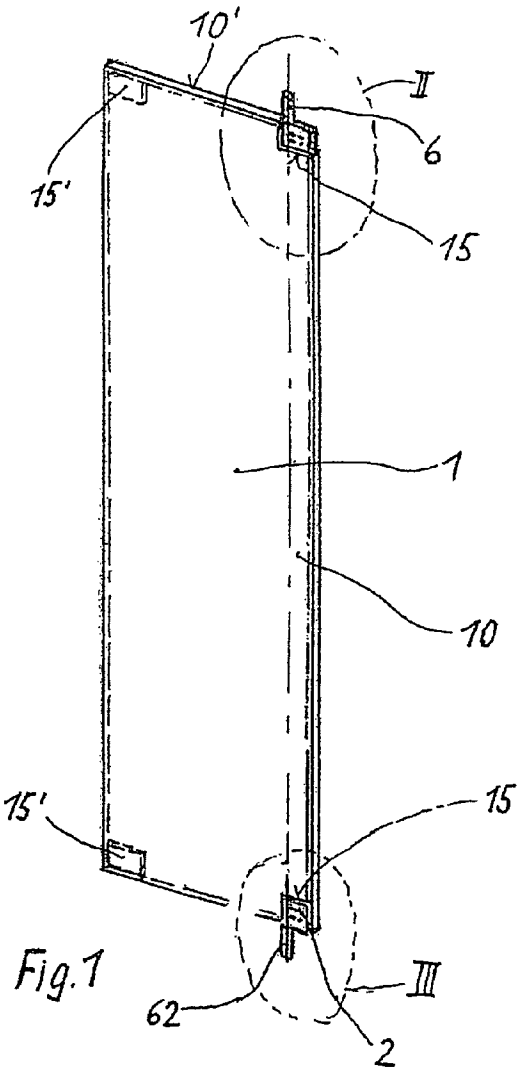
FIG. 1 is a full view of the glass door with bearing.

Reference will now be made to embodiments of the invention, one or more examples of which are illustrated in the drawings. Each embodiment is presented by way of explanation of the invention, and not as a limitation of the invention. For example, features illustrated or described as part of one embodiment may be used with another embodiment to yield still a further embodiment. It is intended that the invention include these and other modifications and variations of the embodiments described herein.

Figure 2:
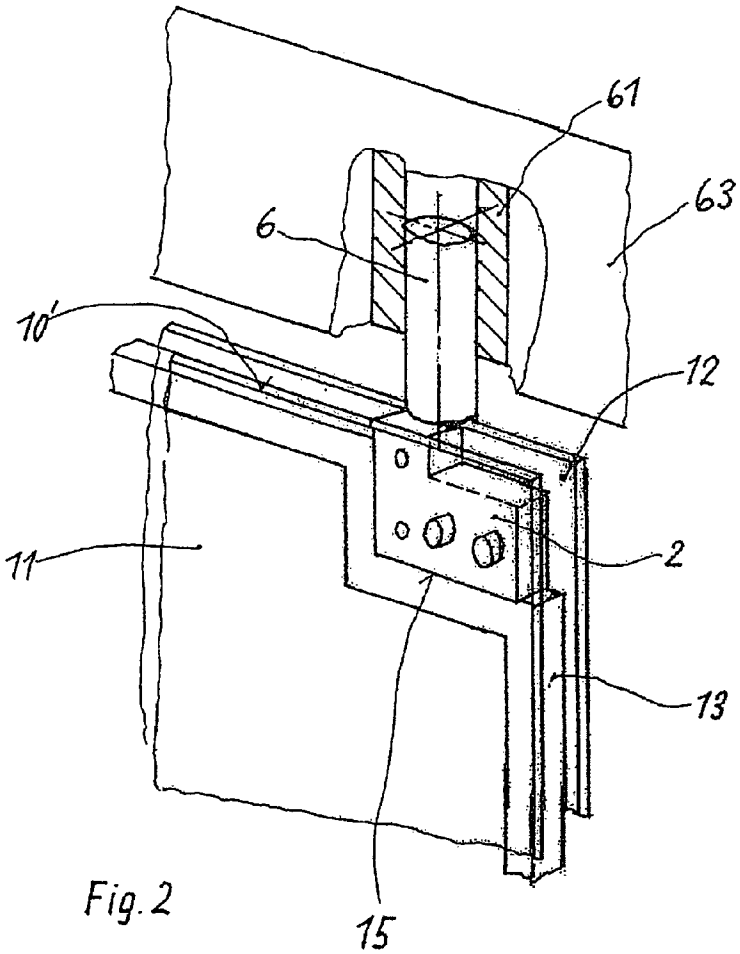
FIGS. 2 & 3 are details II and III from FIG. 1.

Referring to FIGS. 1 and 2, the door 1 consists of two insulation glass panes 11 and 12 supported in conventional fashion by a spacer 13 for creating a hollow space closed on all sides by these spacers 13. Cutouts 15 for the upper and lower end of this edge area are foreseen, and reinforcers 2 have been placed in the cutouts 15 for securing the swivel bolts 6 or 62. The cutout 15 consists suitably only of the spacer 13 so the reinforcers 2 can be pushed between panes 11 and 12 so they can be screwed or glued to the latter. Therefore, the door 1 as such consists of only one, self-supporting insulating glass pane made up of 2 or 3 frameless panes. In the sense of the invention, frameless means that the insulating glass pane has not been placed into a frame that encompasses the pane to support the elements needed for moving the door, but that the insulating glass pane—made up of panes 11 and 12 and their spacer 13—is self-supporting and the elements essential for its movement are attached directly to it. This has the advantage that no condensation water can develop either on the panes 11 and 12 or on the frame owing to their different heating-up or cooling-down.

Figure 4:
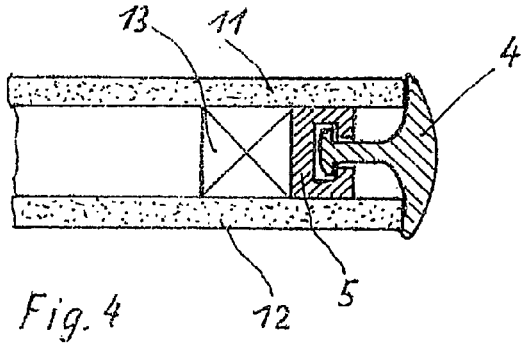
FIG. 4 is a cross-section of the door's edge with a sealing element.
Figure 6:
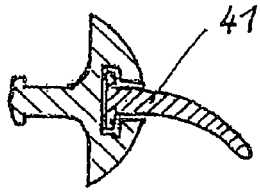
FIGS. 6 & 7 are other embodiments of sealing elements.
Figure 5:
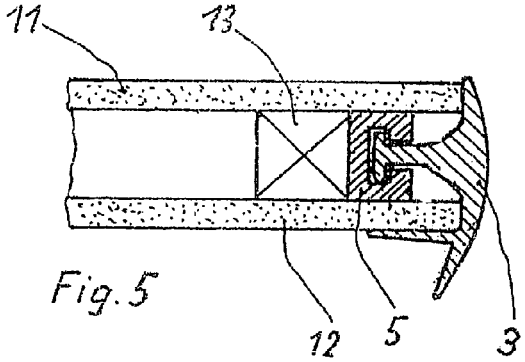
FIG. 5 is a cross-section of the door's edge with a closing element.
Figure 7:
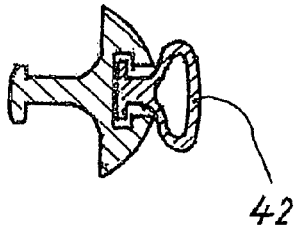
Figure 3:
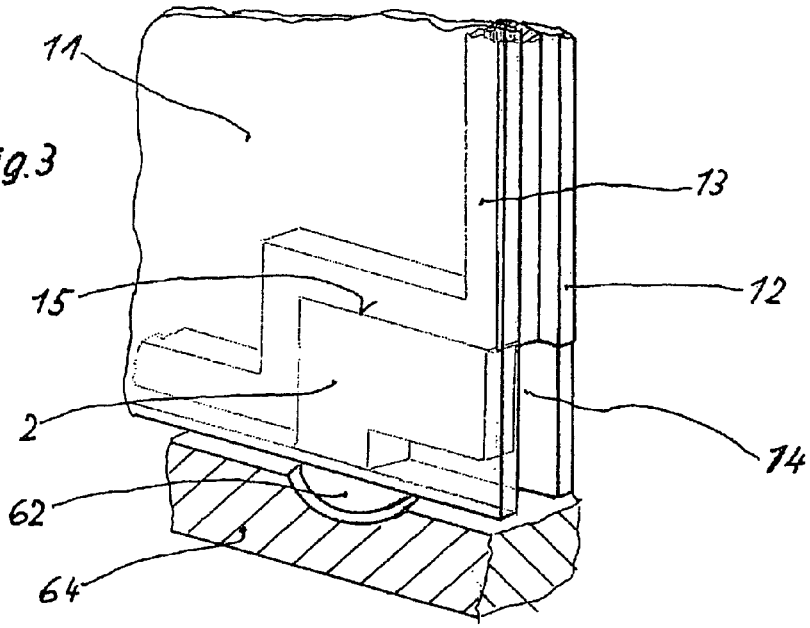

In accordance with the embodiment shown in FIGS. 4 and 5, the panes 11 and 12 of the insulating glass pane 1 protrude over the spacer 13, thereby creating a recess 14 (FIG. 3). This recess 14, which runs along the entire door 1, serves the purpose of creating a seat for a closing element 3 or a sealing element 4 for sealing up the neighboring door, for example, or for a lighting installation arranged in a space between the hinge-side ends of the two doors 1, as described in detail in the related patent application (U.S. application Ser. No. 12/170, 865). Needless to say, the sealing element 4 or the closing element 3 can be glued or be embedded in plastic, for example, but the embodiment shown in FIGS. 3 to 7 is more practical. In this case, a fastening element 5 has been glued in the recess 14, in which the closing element 3 or different embodiments of sealing elements 4, 41, 42—as shown in FIGS. 6 and 7, for example—can be clipped in. Depending on need, this allows one to use different sealing element embodiments or to replace them in case of wear. In addition, only one closing element 3 can be easily put in on the upper or lower edge. The sealing element 4 or 41 (FIG. 6), 42 (FIG. 7)—and the closing element 3 too—also protect the edge of the door 1 to a certain extent against damage or injuries from the sharp glass edges. The sealing elements 4, 41 and 42—as well as the closing element 3—have therefore been designed in a practical way so they overlap or fully cover the edge.

Figure 8:
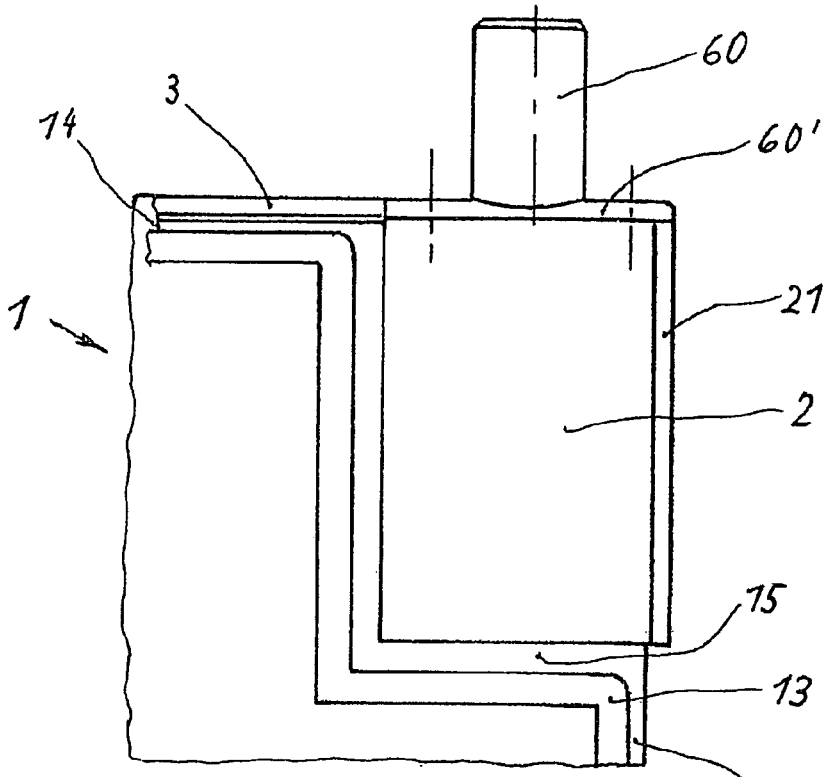
FIGS. 8 & 9 are another design of the swivel bolt attachment on the swivel door.
Figure 9:
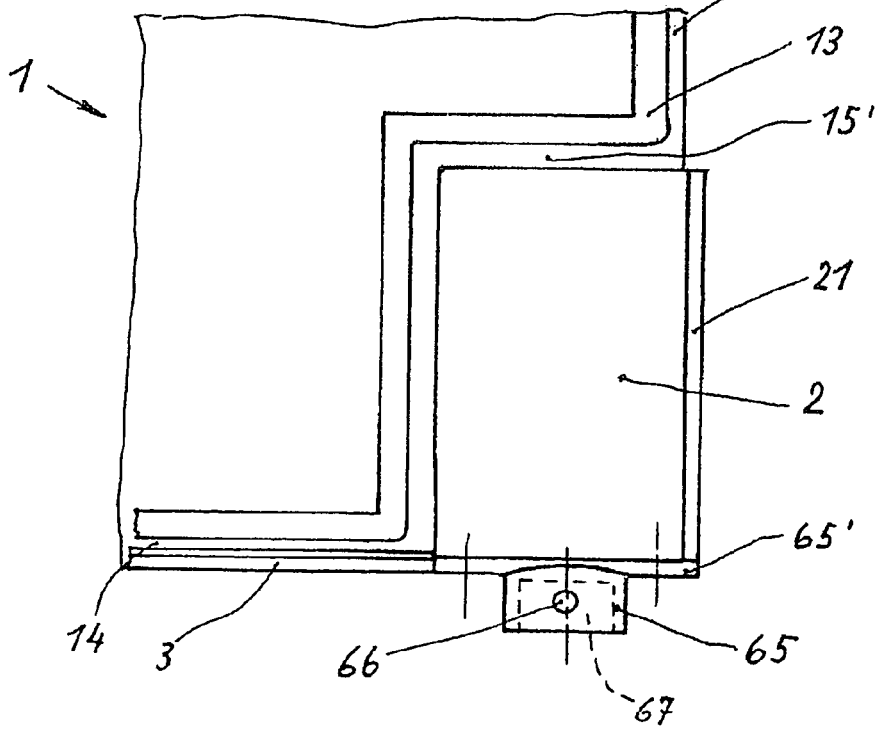

The reinforcers 2 have been made of plastic for practical reasons and placed on the corners in the recesses 15 between the panes 11 and 12 for securing the swivel bolts 6 or 62. They are attached to the insulating glass pane 1 through screwing, but preferentially through gluing. If they are glued, additional working steps in the manufacturing of the insulating glass pane 1 are avoided, and ordinary conventional glass plates can be used for the panes 11 and 12. The gluing of the reinforcers 2 between both glass panes 11 and 12 creates a very stable attachment capable of holding the door securely over the swivel bolts 6. The swivel bolts 6 and 62 have been screwed into the reinforcers 2, and this can be done laterally with respect to the merchandise space or frontally as well (FIGS. 8 and 9). The positioning of the swivel bolts 6 and 62 or 60 and 65 determines the swivel range of door 1. The more the swivel bolts 6 and 62 or 60 and 65 are placed inwards, the deeper the door 1 swivels towards the cabinet's interior when opened. The reinforcers 2 have a stop edge 21 executed in such a way that the closing element 3 or the various sealing devices 40, 41, 42 can attach themselves flush and without protruding. Advantageously, reinforcers 2 can also be arranged in both opposite corners of the door 1 to protect the panes 11 and 12 from damage in this edge area. Additionally, these reinforcers 2 can be executed to allow the installation of heat pipes with the minimum essential bending radius. Please consult the related patent application (DE 10 2008 010 585.6).

The swivel bolt 6 or 60 of the door 1 is placed in a "floating" fashion. This means that it can move in axial direction on the bearing bush 61 (FIG. 2) attached to the merchandise display cabinet. The lower swivel bolt 62 sits on a cup bearing 64 (FIG. 3). It has a thread over which the precise adjusting of the gap distance of the door 1 towards the ceiling frame can take place. As described above, the upper swivel bolt 6 has been arranged on a bearing bush 61 and can thus be moved vertically. This allows height compensation, and door 1 can be adjusted exactly to the opening of the merchandise display cabinet providing access to it. A spring mechanism on the upper end of the swivel bolt 6 closes the opened door 1 automatically.

FIGS. 8 and 9 show an embodiment in which the reinforcer 2 has been glued in each case. The bolt 60 has a foot 60' used for screwing it into the front part of the reinforcer 2. The reinforcer 2 has a stop edge 21 that overlaps the pane edge like the closing element 3 to protect the area of the reinforcer 2 in the panes 11 and 12 against damage. At the same time, this edge 21 positions and firmly attaches the reinforcer 2 during the gluing process.

In the embodiment according to FIGS. 8 and 9, no spring mechanism has been foreseen for closing the door, but a special execution of the lower bearing of the door 1 provides the door 1 with the movement needed for automatic closing, while stopping it in an open position. It can be seen in FIG. 9 that a sleeved swivel bolt 65 has been screwed in place over an attachment plate 65' on the reinforcer 2. The sleeved swivel bolt 65 has been executed as a single piece with the attachment plate 65' and provided with a pin 66 that runs through the bore hole 67 of the swivel bolt 65. On the foot part of the merchandise display cabinet, a bearing neck 70 has been attached over an attachment plate 70' that engages in the bore hole 67 of the swivel bolt 65 in accordance with FIGS. 11 and 12. The bearing neck 70 has sliding surfaces 71 on which the pin 66 moves. Since these sliding surfaces 71 have a sharp downward inclination, the weight of the door 1 causes the pin 66 to slide downwards along these surfaces, thereby swiveling the door to the closing position. When the pin 66 reaches the upper end of the sliding surfaces 71 as the door 1 is opened, the pin 66 will reach a latch 72 that will stop the door 1 in this opening position. If the door 1 is moved out of this latched position, the door opening of the refrigeration cabinet will close by itself.

Figure 10:
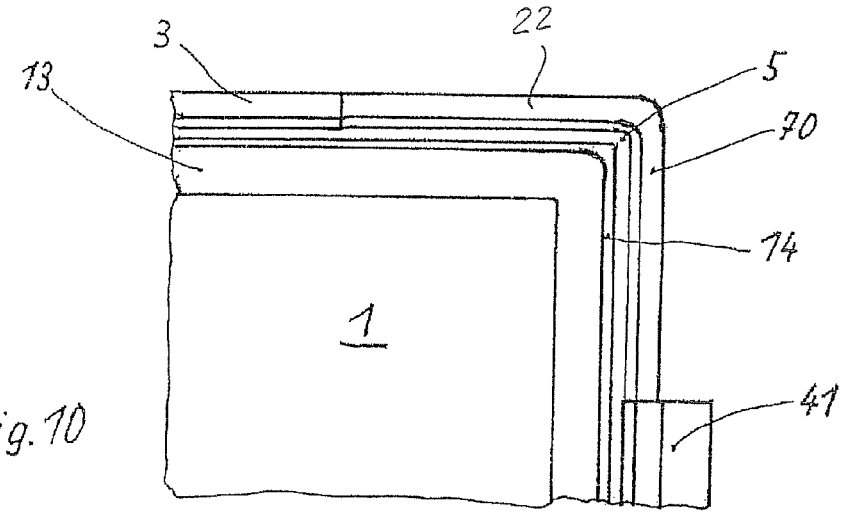
FIG. 10 is a corner protector for the door.

Instead of using reinforcers 2, the corner edges of door 1 can also be protected by a reinforced closing element. FIG. 10 shows such an edge protector 22, but the otherwise typical closing element 3 or sealing element 41 has been replaced by a more stable plastic or metal part in the edge corner. The panes 11 and 12 of the insulating glass pane protrude above the spacer 13, thus creating a recess 14 in which a fastening part 5 has been glued. While a closing element 3 has been clipped into the fastening element 5 located on the upper edge of the door 10', the edge protector 22 has been clipped above the corner. This is continued by a sealing element 41 held by the fastening element 5. This arrangement provides excellent protection to the especially damage-prone corners of the insulating glass pane 1.

Figure 11:
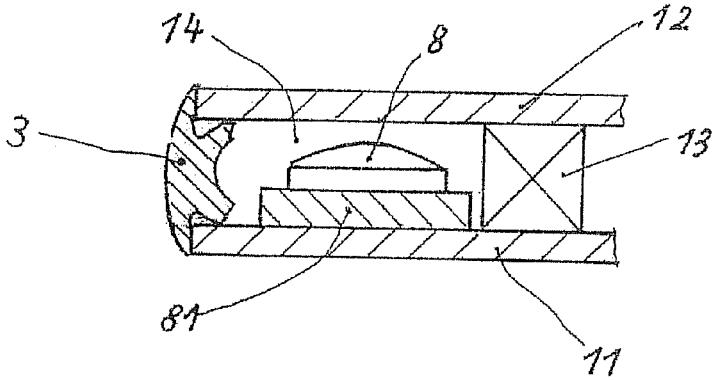
FIG. 11 is the arrangement of a lighting installation.
Figure 12:
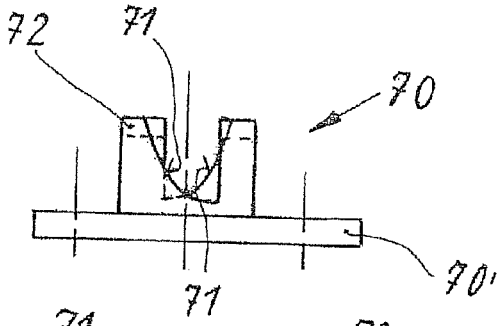
FIGS. 12 & 13 are the lower bearing of a swivel door in accordance with FIG. 9, with an automatic closing and blocking mechanism.
Figure 13:
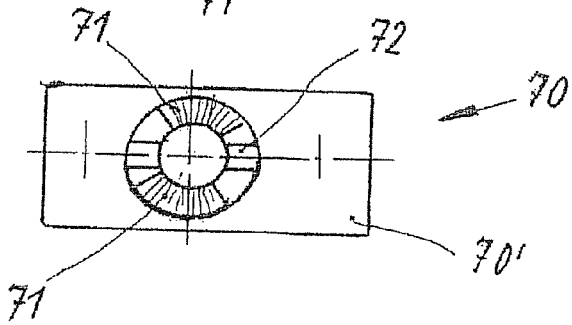

In FIG. 11, one can see the recess 14 executed deeper in special fashion between the panes 11 and 12 and the spacer 13 to provide space for lighting installation, especially if it is made up of LED luminous elements. A series of LED luminous elements 8 has been arranged on a strip 81 executed as a refrigeration part 81, and this refrigeration part 81 has been attached to pane 11 that faces the warm surrounding space of the merchandise display cabinet, while pane 12 faces the refrigerated cabinet space. The recess 14 has been closed by a closing element 3. Because the refrigeration part 81 of the LED illumination has been attached to the outer pane 11, this area (which is especially prone to fogging caused by condensed water) is heated by the heat that the LED luminous element 8 generates, whereas the light is merely radiated into the refrigerated merchandise space through pane 12 without generating heat. Although the spacer 13 creates a temperature bridge, the conventional heat wires for preventing the fogging of this edge area become superfluous.

In accordance with the invention, the simple, frameless structure of the door is by all means also suitable for being installed subsequently to existing, door-less merchandise display cabinets with vertical access openings. In this case, it is advantageous that no frame for attaching hinges and the like is needed. The existing frame construction of the merchandise display cabinet is sufficient for installing the bearings 61, 64, 67 for the swivel bolts 6, 60, 62, 65 to firmly attach the doors 1. In accordance with the invention, sliding frameless doors can also be used. Instead of the swivel bolts used in the swivel doors, the required sliding and supporting elements are also directly attached to the door 1 executed as insulating glass. In the case of smaller doors, where the load of the supporting and sliding elements is not as large, it is sufficient the clip the supporting and sliding elements on the fastening elements 5 used in the recess 14. If larger stresses and forces occur, then it is advisable to create cutouts through the spacer 13 in the door edge, as was done with the swivel bolts, and to place reinforcers there in the same fashion on which the supporting and sliding elements can be screwed in. Just like the swivel doors, the sliding doors can be also be equipped with closing elements 3, edge protectors 22 and sealing elements 4, 41 42. In addition, the recess 14 can also be deepened so a lighting installation 8, 81 can be accommodated there. Only the elements for swivel movement are replaced with those allowing sliding movement.

The frameless, self-supporting door design has proven to be highly advantageous both for swivel doors and for sliding doors. The fogging of the panes is prevented and the frameless execution ensures an unrestricted view to the displayed goods.

Modifications and variations can be made to the embodiments illustrated or described herein without departing from the scope and spirit of the invention as set forth in the appended claims.

The invention claimed is:

1. A door for a merchandise display cabinet that displays and provides access to customers to refrigerated or frozen goods stored in vertical stacked compartments within the display cabinet, said door comprising:

a frameless insulated glass assembly comprising at least two separate panes of glass separated by a spacer so as to define an insulating air space between said glass panes;

said spacer disposed between said glass panes and attached to opposite inner facing surfaces of said glass panes without extending beyond circumferential edges of said glass panes; and mechanical components on said door configured for mounting said door to the merchandise display cabinet so that said door opens and closes relative to said merchandise display cabinet, said mechanical components attached to said door without a supporting frame member that attaches over or encompasses said circumferential edges of said glass panes; wherein said door is configured to swing open and closed relative to said merchandise display cabinet, said mechanical components comprising swivel bolt assemblies attached directly to said glass panes in corners of said door; wherein said swivel bolt assemblies further comprise a reinforcer member attached to said inner facing surfaces of said glass panes in said corners; further wherein said spacer is bent inwardly at said corners so as to define cutout recesses in said corners for accommodating said reinforcer members between said glass panes.

2. The door as in claim 1, wherein said spacer sets inward of said circumferential edges of said glass panes so as to define a circumferential recess around said glass panes, said spacer having a shape in said corners such that said recess is expanded to said cutout recess that accommodates said reinforcer members.

3. The door as in claim 1, wherein said reinforcer members are glued to said panes of glass.

4. The door as in claim 1, wherein said spacer sets inward of said circumferential edges of said glass panes so as to define a circumferential recess around said glass panes, and wherein said glass panes extend past said spacer by a different degree around at least a portion of said door.

5. The door as in claim 1, wherein said spacer sets inward of said circumferential edges of said glass panes so as to define a circumferential recess around said glass panes, and further comprising a combination of sealing or closing elements that sets into said recess along at least one edge of said door and extends outward from said recess past said edges of said glass panes.

6. The door as in claim 5, wherein said sealing or closing elements have a configuration so as to enclose said edge of said glass pane configured as a front panel of said door.

7. The door as in claim 5, further comprising a fastening element within said recess, said sealing or closing elements attached to said fastening element.

8. The door as in claim 1, wherein said spacer sets inward of said circumferential edges of said glass panes so as to define a circumferential recess around said glass panes, and further comprising a lighting installation configured in said recess along at least one edge of said door.

9. A merchandise display cabinet that displays and provides access to customers to refrigerated or frozen goods stored in vertical stacked compartments within the display cabinet, said display cabinet further comprising a frame and a door mounted to said frame, said door comprising:

a frameless insulated glass assembly comprising at least two separate panes of glass separated by a spacer so as to define an insulating air space between said glass panes;

said spacer disposed between said glass panes and attached to opposite inner facing surfaces of said glass panes without extending beyond circumferential edges of said glass panes; and mechanical components on said door configured for mounting said door to said frame so that said door opens and closes relative to said merchandise display cabinet, said mechanical components attached to said door without a supporting frame member that attaches over or encompasses said circumferential edges of said glass panes wherein said door is configured to swing open and closed relative to said merchandise display cabinet, said mechanical components comprising upper and lower swivel bolt assemblies attached directly to said glass panes in corners of said door; wherein said swivel bolt assemblies further comprise a reinforcer member attached to said inner facing surfaces of said glass panes in said corners; further wherein said spacer is bent inwardly at said corners so as to define cutout recesses in said corners for accommodating said reinforcer members between said glass panes.

10. The merchandise display cabinet as in claim 9, wherein said frame comprises a bearing bushing in an upper frame member, said upper swivel bolt assembly comprising a bolt that is axially moveable within said bearing bushing such that a space between an upper edge of said door and said upper frame member is adjustable.

11. The merchandise display cabinet as in claim 10, wherein said frame comprises an adjustable cup bearing in a lower frame member that receives a bolt of said lower swivel bolt assembly, whereby adjustment of said cup bearing adjusts the space between said upper edge of said door and said upper frame member.

12. The merchandise display cabinet as in claim 9, wherein said frame comprises a bearing in a lower frame member that receives a bolt of said lower bolt assembly, said bearing further comprising an automatic closing mechanism.

13. The merchandise display cabinet as in claim 12, wherein said bolt comprises a pin that slides along an inclined sliding surface in said bearing when said door is opened.

14. The merchandise display cabinet as in claim 13, wherein said closing mechanism further comprises a latch that maintains said door in an open position.

15. The merchandise display cabinet as in claim 9, wherein said spacer sets inward of said circumferential edges of said glass panes so as to define a circumferential recess around said glass panes, said spacer having a shape in said corners such that said recess is expanded to said cutout recess that accommodates said reinforcer members.

* * * * *